US007507327B2

(12) United States Patent
Dysard et al.

(10) Patent No.: US 7,507,327 B2
(45) Date of Patent: Mar. 24, 2009

(54) DESULFURIZING ORGANOSULFUR HETEROCYCLES IN FEEDS WITH SUPPORTED SODIUM

(75) Inventors: Jeffrey M. Dysard, Michigan City, IN (US); Zhigou Hou, Baton Rouge, LA (US); Jonathan M. McConnachie, Annandale, NJ (US); Andrzej Malek, Baton Rouge, LA (US); Ramesh Gupta, Berkeley Heights, NJ (US); William E. Lewis, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 219 days.

(21) Appl. No.: 11/227,802

(22) Filed: Sep. 14, 2005

(65) Prior Publication Data

US 2006/0065577 A1 Mar. 30, 2006

Related U.S. Application Data

(60) Provisional application No. 60/614,812, filed on Sep. 30, 2004.

(51) Int. Cl.
*C10G 19/073* (2006.01)
*C10G 29/04* (2006.01)

(52) U.S. Cl. ..... 208/208 M; 208/227; 208/230

(58) Field of Classification Search ..... 208/208 M, 208/208 R, 209, 211, 212, 213, 226, 227, 208/228, 229, 230
See application file for complete search history.

(56) References Cited

U.S. PATENT DOCUMENTS

| | | | | |
|---|---|---|---|---|
| 3,093,575 | A | 6/1963 | Kimberlin, Jr. et al. | |
| 3,496,098 | A | 2/1970 | Sprendlingen | 208/230 |
| 3,785,965 | A | 1/1974 | Welty | 208/208 M |
| 3,787,315 | A | 1/1974 | Bearden, Jr. et al. | 208/208 M |
| 3,788,978 | A | 1/1974 | Bearden, Jr. et al. | 208/208 M |
| 3,791,966 | A | 2/1974 | Bearden, Jr. | 208/208 M |
| 3,976,559 | A * | 8/1976 | Bearden et al. | 208/208 M |
| 4,003,824 | A | 1/1977 | Baird, Jr. et al. | 208/108 |
| 4,076,613 | A | 2/1978 | Bearden, Jr. | 208/108 |
| 5,935,421 | A | 8/1999 | Brons et al. | 208/226 |
| 6,193,877 | B1 | 2/2001 | McVicker et al. | 208/217 |
| 6,210,564 | B1 | 4/2001 | Brons et al. | 208/208 M |
| 6,245,221 | B1 | 6/2001 | Baird, Jr. et al. | 208/213 |
| 6,251,262 | B1 | 6/2001 | Hatanaka et al. | 208/210 |

OTHER PUBLICATIONS

B.M. Vanderbilt, Desulfurization and Refining of Naphthas by Metallic Sodium, 49 Ind. Eng. Chem. 4, 696-703 (1957).*

J.L. Gerlock et al., Reaction of Thiophene with Sodium on Alumina: A Method for Desulfurization of Volatile Fuels, 17 Ind. Eng. Chem. Fundam. 1, 23-28 (1978).*

Gerlock, J. L., "Reaction of Thiophene with Sodium on Alumina. A Method for Desulfurization of Volatile Fuels," *Industrial and Engineering Chemistry Fundamentals*, vol. 17, No. 1, 1978, pp. 23-28.

Vanderbilt, B. M., "Desulfurization and Refining of Naphthas by Metallic Sodium," *Industrial and Engineering Chemistry*, vol. 49, No. 4, 1957, pp. 696-703.

* cited by examiner

*Primary Examiner*—Glenn Caldarola
*Assistant Examiner*—Randy Boyer
(74) *Attorney, Agent, or Firm*—Lawrence E. Carter; Paul E. Purwin

(57) ABSTRACT

Refractory or hard sulfur found in a hydrocarbon stream containing refractory sulfur heterocycle compounds, particularly those exhibiting steric hindrance, is removed from the stream by contacting it with a sodium reagent comprising a sodium component, having free sodium, supported on a solid support component. If the hydrocarbon stream contains more labile or easy sulfur, then it is treated, typically by hydrodesulfurization, to remove at least most of the labile sulfur before it is contacted with the sodium reagent. This is useful for bringing the sulfur level of middle distillate fuel streams, such as diesel and jet fuel fractions, down to a level of less than about 10 wppm, employing conventional hydrodesulfurizing catalysts and conditions.

13 Claims, No Drawings

DESULFURIZING ORGANOSULFUR HETEROCYCLES IN FEEDS WITH SUPPORTED SODIUM

CROSS REFERENCE TO RELATED APPLICATION

This application claims benefit of U.S. Provisional Patent Application Ser. No. 60/614,812 filed Sep. 30, 2004.

FIELD OF THE INVENTION

The invention relates to desulfurizing refractory organosulfur heterocycle compounds in a hydrocarbon liquid using a solid reagent comprising supported free sodium. More particularly the invention comprises desulfurizing a hydrocarbon liquid, such as a diesel fraction which contains refractory organosulfur heterocycles, by contacting it with a solid reagent comprising supported sodium having a free sodium content.

BACKGROUND OF THE INVENTION

There is an increasing need for reduced sulfur levels in petroleum and chemical streams due to increasingly stricter environmental requirements. This is especially so for middle distillate fuels such as diesel fuel, jet fuel, kerosene, heavy furnace oils and the like, whose combustion products are released into the environment. In hydrocarbon streams derived from petroleum refining and chemical processing, sulfur is present in the form of organosulfur compounds and is typically removed by a process known as hydrodesulfurization. In this process, the stream is contacted with hydrogen, in the presence of a suitable catalyst, to convert the sulfur in the organosulfur compounds to $H_2S$. The $H_2S$ is then separated from the sulfur-reduced stream. Simple, sulfur-bearing organic compounds, such as aliphatic, naphthenic, and aromatic mercaptans, sulfides, di- and polysulfides and the like, are relatively easy to hydrodesulfurize and the sulfur in these types of compounds, being relatively easy to remove, is therefore referred to as "labile sulfur". It is much more difficult to remove sulfur from more refractory sulfur compounds, such as derivatives of dibenzothiophene, especially those mono- and di-substituted and condensed ring dibenzothiophenes that exhibit steric hindrance, and sulfur in these compounds is referred to as refractory sulfur. These highly refractory sulfur heterocycles are present in the higher boiling [e.g., about 500 to about 800° F. (260-427° C.)] fractions of middle distillate streams and resist hydrodesulfurization, as a consequence of the steric inhibition precluding the requisite catalyst-substrate interaction.

Removing sulfur from these refractory sulfur heterocycles can be achieved under relatively severe hydrodesulfurization process conditions, but this requires high temperatures and pressures, is expensive, and can result in product loss due to cracking and degradation. As a consequence, processes have been developed to remove these refractory sulfur heterocycles from streams that have previously been substantially desulfurized, and typically by conventional hydrodesulfurization. For example, U.S. Pat. Nos. 6,193,877 and 6,245,221 relate to hydrodesulfurizing such sulfur-reduced streams, which still contain refractory sulfur heterocycles, in the presence of an $H_2S$ sorbent and a catalyst comprising noble metal or nickel on a particulate support. U.S. Pat. No. 6,251,262 discloses the use of three separate stages and catalysts to remove them, to produce product having about 0.005 wt. % (≦50 wppm) or less sulfur. This is still too high for many specifications. U.S. Pat. No. 6,210,564 discloses the use of sodium metal to remove sulfur from petroleum-derived feeds, but this requires special handling and forms sludge, which must be separated from the treated oil. The literature discloses the use of free and supported sodium for removing thiophene from naphtha, but doesn't address or suggest that this would be effective for the higher boiling, refractory sulfur heterocycles found in higher boiling streams. Examples are found in (i) B. M. Vanderbilt, "Desulfurization and Refining of Naphthas by Metallic Sodium," *Ind. & Eng. Chem., v.* 49, n. 4, April, 1957 and (ii) Gerlock, et. al. in "Reaction of Thiophene with Sodium on Alumina. A Method for Desulfurization of Volatile Fuels," *Ind. Eng. Chem. Fundam.*, v. 17, n. 1, 1978. There is a need for a process that can remove sulfur from these refractory sulfur heterocycles and particularly from middle distillate streams, without resorting to expensive catalysts, difficult processes employing multiple catalytic stages and catalysts, and severe hydrodesulfurization conditions.

SUMMARY OF THE INVENTION

A process has now been found for removing refractory sulfur from a hydrocarbon stream, such as a petroleum and a chemical hydrocarbon stream, which comprises contacting the stream with a sodium reagent comprising free sodium on a particulate solid support (hereinafter "sodium reagent"). By free sodium is meant sodium that is supported on, but not chemically bound to, the support material and which will react with water or moisture. The preparation of a sodium reagent useful in the process of the invention can be achieved by simply impregnating the support with sodium, in an amount sufficient for the supported sodium to have a free-sodium content, as is explained in detail below. The free sodium will react with most sulfur and not just refractory sulfur, and is therefore preferably used after the hydrocarbon stream has first been treated to remove sulfur from more labile sulfur compounds in the stream. The more labile sulfur is removed from a sulfur-bearing hydrocarbon stream by any suitable means, but typically and preferably by hydrodesulfurization for petroleum and chemical hydrocarbon streams. By "labile sulfur" is meant sulfur in relatively simple sulfur-containing organic compounds, such as aliphatic, naphthenic, and aromatic mercaptans, sulfides, di- and polysulfides and the like, which do not exhibit steric hindrance. By refractory sulfur is meant sulfur in organic heterocycle sulfur compounds. (refractory sulfur heterocycles), such as derivatives of dibenzothiophene, especially mono- and di-substituted, and condensed ring dibenzothiophenes, which exhibit steric hindrance.

Thus, in one embodiment the invention comprises a process for removing sulfur from a sulfur-bearing hydrocarbon stream containing both labile and refractory sulfur, which comprises contacting it with hydrogen in the presence of a hydrodesulfurizing catalyst, at reaction conditions effective to remove labile sulfur, but not refractory sulfur, to produce a sulfur-reduced stream, followed by contacting the sulfur-reduced stream with a sodium reagent to remove at least a portion of the refractory sulfur, to further reduce its sulfur content. By removing labile sulfur is meant that at least a portion, and preferably at least most or all the sulfur in the labile sulfur compounds, is removed. By not removing refractory sulfur means not removing more than about 10 wt. %.

As is known, hydrodesulfurization converts sulfur in sulfur-bearing organic compounds to $H_2S$. $H_2S$ that is not removed from the sulfur-reduced stream will react with the free sodium of the reagent and, if present in sufficient amounts, may consume the free sodium before it can remove the refractory sulfur. Therefore $H_2S$ is preferably removed from the sulfur-reduced stream before it is contacted with the reagent. In another embodiment, the invention comprises removing refractory sulfur remaining in a hydrocarbon stream that has previously been hydrodesulfurized to remove at least a portion and preferably most or all of the labile sulfur, by contacting it with the sodium reagent to further reduce its sulfur content.

In the case of a middle distillate stream, conventional hydrodesulfurizing may reduce its sulfur content down to between about 40 to about 100 wppm. Contacting the hydrodsulfurized, sulfur-reduced stream with the solid reagent will further reduce its sulfur content. The process of the invention makes it possible to reduce the sulfur content down to a level of less than 10 wppm by using the sequential steps of (i) hydrodesulfurizing to produce a sulfur-reduced stream and $H_2S$, (ii) separating the $H_2S$ from the stream and then (iii) contacting the $H_2S$ reduced stream with the sodium reagent. This enables deeper desulfurization using existing conventional hydrodesulfurization equipment, process conditions and catalysts. Thus, another embodiment of the invention comprises a process for removing sulfur from a sulfur-bearing, middle distillate hydrocarbon stream containing both labile and refractory sulfur, which comprises reacting it with hydrogen in the presence of a hydrodesulfurizing catalyst, at reaction conditions effective to remove labile sulfur to produce a sulfur-reduced stream, followed by contacting the sulfur-reduced stream with a sodium reagent to remove at least a portion of the refractory sulfur, to further reduce its sulfur content down to a level of less than about 10 wppm.

DETAILED DESCRIPTION

Hydrodesulfurization is a process in which the sulfur content of a sulfur-bearing hydrocarbon stream is reduced by contacting it with hydrogen or a hydrogen-containing treat gas, in the presence of one or more suitable hydrodesulfurization catalysts active for the removal of sulfur, at reaction conditions effective for the hydrogen to react with sulfur-bearing organic compounds present in the stream, and remove the sulfur as $H_2S$. As is known, during hydrodesulfurization other heteroatoms such as nitrogen and oxygen are removed, along with saturation of at least some aromatics and other unsaturates. Hydrodesulfurization catalysts are well known and include, for example, catalysts comprising one or more Group VIII metal catalytic components, typically non-noble metals such as Fe, Co and Ni, and more typically Co and/or Ni, and one or more Group VI metal catalytic components, typically Mo and W, with Mo being most often used, on a high surface area support material, such as alumina. The Groups referred to herein refer to Groups as found in the Periodic Table of the Elements copyrighted in 1968 by the Sargent-Welch Scientific Company. Other suitable hydrodesulfurization catalysts include zeolitic catalysts, as well as noble metal catalysts, wherein the noble metal is selected from Pd and Pt. However, conventional hydrodesulfurization typically employs the less expensive non-noble metal catalysts. Typical non-noble metal hydrodesulfurization catalysts include, for example, Ni/Mo on alumina, Co/Mo on alumina, Co/Ni/Mo on alumina, and the like. Hydrodesulfurization conditions typically include temperatures in the range of from about 530 to about 750° F. (277-400° C.), preferably about 600 to about 725° F. (316-385° C.), and most preferably about 600 to about 700° F. (316-371° C.), at a total pressure in the range of about 100 to about 2000 psi (715-11436 kPa), a hydrogen treat gas rate in the range of about 300 to about 3000 SCF/B (53 to 534 S $m^3$ of $H_2/m^3$ of oil), and a feed space velocity of about 0.1 to about 2.0 LHSV. By "hydrogen treat gas" is meant either pure hydrogen or a hydrogen-containing gas stream containing hydrogen in an amount at least sufficient for the intended reaction, plus other gas or gasses (e.g., nitrogen and light hydrocarbons such as methane) which will not adversely interfere with or affect either the reaction or the product.

The sodium reagent useful in the process of the invention is a composite of a sodium component comprising both supported and free sodium (free sodium is sometimes referred to as active sodium), and a support component. As set forth above, preparation of the reagent may be achieved by simple impregnation of a support component, such as alumina, carbon, silica and the like, with molten metallic sodium under vacuum or an inert atmosphere. The Gerlock, et. al. and Vanderbilt articles referred to above give preparation techniques for preparing a supported sodium reagent having free sodium. It is preferred to protect the supported sodium reagent from exposure to water. The free sodium content, which may range from about 1 to about 20 wt. % of the total weight of the composite of sodium and support components, may be determined by measuring the volume of hydrogen released upon reaction of the reagent with 2-methoxyethanol, which is also disclosed in Gerlock, et. al., the disclosure of which is incorporated herein by reference. Another method that may be used to determine the free or active sodium content, is to react a measured amount of the reagent and $H_2O$, measure the amount of evolved hydrogen (by Gas Chromatography, for example) and then calculate the amount of free or reactive sodium based on the amount of hydrogen released. Contacting a hydrocarbon stream containing refractory sulfur with the sodium reagent may be achieved at temperatures ranging from about 212 to about 752° F. (100-400° C.), preferably from about 482 to about 662° F. (250-350° C.) and pressures ranging from below atmospheric to about 400 psig (2859 kPa). The reagent may be present in a guard bed through which a hydrodesulfurized stream, separated from the $H_2S$ produced by the hydrodesulfurization reaction, but still containing refractory sulfur, is passed to remove the refractory sulfur. This permits lower sulfur levels to be achieved using conventional hydrodesulfurization conditions and catalysts. The sulfur in so-called labile or easy sulfur compounds can be removed without using severe process conditions.

The prior art teaches that substantially more severe conditions are needed to remove sulfur from the so-called "hard" or refractory sulfur compounds referred to herein as refractory sulfur heterocycles during hydrodesulfurization, which are typically present in middle distillate fractions derived from one or more naturally-occurring hydrocarbon sources, such as petroleum, bitumen, shale oil and the like, as derivatives of dibenzothiophene, especially those mono- and di-substituted and condensed ring dibenzothiophenes, which exhibit steric hindrance or inhibition. Steric hindrance tends to make the requisite catalyst-substrate interaction with the sulfur atom in the molecule difficult and thereby substantially reduces the sulfur removal reaction kinetics. It retards inter- or intramolecular interactions as a result of the spatial structure of the molecule preventing access to the sulfur atom. Illustrative, but non-limiting, examples of such refractory sulfur heterocycles include 1-, 2- and 3-methyldibenzothiophenes, 4-methyldibenzothiophene and 4,6-dimethyldibenzothiophene. The effect of steric hindrance on relative reaction kinetics of sulfur removal can be seen in an article by D. D. Whitehurst, et. al., titled "Present State of the Art and Future Challenges in the Hydrodesulfurization of Polyaromatic Sulfur Compounds," in *Advances In Catalysis*, v. 47, p. 345-471, 1998. In this article, the relative reaction rates of 4-methyldibenzothiophene and 4,6-dimethyldibenzothiophene relative to dibenzothiophene are given as 0.3 and 0.1, respectively.

These highly refractory sulfur heterocycles are present in the higher boiling e.g., from about 600 to about 850° F. (316-454° C.) and more typically from about 650 to about 850° F. (343-454° C.) fractions of petroleum and other mineral-derived middle distillate streams, and resist hydrodesulfurization as a consequence of their steric hindrance. Feed streams suitable for being treated by the present invention are those petroleum based feeds or streams which contain condensed ring sulfur heterocyclic compounds, as well as other ring compounds, including multi-ring aromatic and naphthenic compounds. They are also found in similar boiling range fractions derived from some chemical processes and those obtained or derived from tar sand bitumen, shale oil and other naturally occurring, mineral types of hydrocarbon sources. However, the invention is not intended to be limited to just these feeds and feed sources. As set forth above, in a broad sense, the invention is useful for removing refractory sulfur from a hydrocarbon stream, and this could be any hydrocarbon stream that will not, of itself, react with the sodium reagent.

Non-limiting examples of such feeds include diesel fuels, jet fuels, heating oils, and lubes. The feeds may also include feeds derived from synthetic processes, such as the Fischer-Tropsch process, which have been blended with feeds from naturally-occurring feeds. Such feeds typically have a boiling range from about 240 to about 1112° F. (116-600° C.), preferably from about 347 to about 752° F. (175-400° C.). The invention is particularly useful with middle distillate feeds typically boiling in the range of from about 240 to about 850° F. (116-454° C.) and, at the option of the practitioner, the higher boiling heavy diesel fractions [e.g., from about 600 to about 850° F. (316-454° C.)] of middle distillate feeds that contain the refractory sulfur. In the process of the invention, it is preferred that the feed first be hydrodesulfurized to reduce its sulfur content to less than about 150 wppm sulfur, preferably less than about 100 wppm, more preferably less than about 50 wppm, and still more preferably less than about 40 wppm sulfur, before it is contacted with the sodium reagent. The contacting with the sodium reagent may take place in the presence or absence of hydrogen. The invention will be further understood with reference to the examples below.

EXAMPLES

Example 1

Diethyldibenzothiophene, a highly stericly hindered, refractory sulfur heterocycle, in an amount of about 0.579 g was dissolved in sufficient hexadecane to achieve a concentration of about 1000 wppm. This solution was added to about 0.56 g of a sodium reagent comprising solid, supported sodium on alumina, under dry argon. The amount of Na (sodium metal) on the alumina comprised about 12% of the total weight of the composite, with about 2 wt. % of the total weight of the composite free or active Na. The mixture was then heated to about 392° F. (200° C.) at atmospheric pressure under argon. Samples of the solution were removed after 21, 25 and 45 hours, and analyzed for hexadecane and diethyldibenzothiophene by gas chromatography. The amount of diethyldibenzothiophene removed was 32, 42 and 93 wt. %, respectively. The reaction stoichiometry was calculated to be about 5:1 atoms of sodium per atom of sulfur, which was close to the theoretical of about 4:1. This demonstrates that the sodium reagent removed the sulfur from the diethyldibenzothiophene.

Example 2

A diesel feed comprising a hydrocarbon fraction boiling in the diesel fuel range of from about 300 to about 800° F. (149-427° C.) is obtained by fractionating a petroleum crude oil. It contains about 15000 wppm (1.5 wt. %) sulfur in the form of aliphatic, naphthenic, and aromatic mercaptans, sulfides, di- and polysulfides and stericly hindered refractory sulfur heterocycles. This stream is hydrodesulfurized by contacting it with a hydrodesulfurization catalyst, comprising cobalt and molybdenum supported on an alumina support, in the presence of hydrogen, at reaction conditions of about 650° F. (343° C.), a hydrogen treat gas rate of about 1500 SCF/B (267 S $m^3$ of $H_2/m^3$ of oil), an LHSV of about 0.5, and a hydrogen pressure of about 325 psi (2324 kPa). This removes most of the sulfur as $H_2S$ and reduces the sulfur content down to about 55 wppm sulfur, most of which is in the form of one or more refractory sulfur heterocycles. The $H_2S$ is separated from the feed by flashing and/or stripping. The stripped and/or flashed feed is then contacted with a sodium reagent comprising sodium supported on alumina. The sodium reagent is in the form of a fixed bed of reagent mixed with alumina and is in a guard bed downstream of the stripper. The amount of sodium is about 12 wt. % of the reagent, with about 2.4 wt. % of the reagent being free or active sodium. Contacting is conducted at a temperature of about 600° F. (316° C.) and a pressure of about 300 psig (2170 kPa). This further reduces the sulfur content of the diesel feed down to less than about 10 wppm sulfur.

What is claimed is:

1. A process for removing refractory sulfur from a middle distillate fuel fraction that includes a fraction boiling in the range of about 260 to 427° C. and that contains refractory sulfur, which process comprises contacting said middle distillate fuel fraction with a sodium reagent comprising a sodium component having free sodium, supported on a particulate solid support component at a temperature of from about 100 to 400° C. and a pressure of from below atmospheric to about 400 psig, wherein said middle distillate fuel fraction has been hydrodesulfurized under effective conditions to remove more labile sulfur to reduce the total sulfur content to less than 150 wppm before it is contacted with said sodium reagent.

2. A process according to claim 1 wherein said free sodium is present in an amount of from about 1 to about 20 wt. % of said sodium reagent.

3. A process according to claim 2 wherein said sodium reagent also contains sodium bound to said support component.

4. A process according to claim 3 wherein said middle distillate fuel fraction is derived from a naturally occurring hydrocarbon source.

5. A process for removing sulfur to 10 wppm or less from a sulfur-bearing middle distillate fuel stream that includes a fraction boiling in the range of about 260 to 427° C. and that contains both labile and refractory sulfur, which process comprises contacting said stream with hydrogen in the presence of a hydrodesulfurization catalyst, at reaction conditions effective to remove labile sulfur, to produce a sulfur-reduced stream having a sulfur content of 40 to 100 wppm, followed by contacting said sulfur-reduced stream with a sodium reagent, comprising free sodium on a solid support component, under effective conditions to remove at least a portion of said refractory sulfur, to produce a hydrocarbon stream having a further reduced sulfur content of 10 wppm or less, wherein the sulfur-reduced stream is contacted with the sodium reagent at a temperature of from about 100 to 400° C. and a pressure of from below atmospheric to about 400 psig.

6. A process according to claim 5 wherein at least most of said labile sulfur is removed by said hydrodesulfurization.

7. A process according to claim 6 wherein not more than about 10 wt. % of said refractory sulfur is removed by said hydrodesulfurization.

8. A process according to claim 5 wherein said hydrocarbon stream having a further reduced sulfur content has less than about 10 wppm sulfur.

9. A process for removing labile and refractory sulfur to 10 wppm or less from a sulfur-bearing middle distillate fuels boiling range stream derived from one or more naturally-occurring hydrocarbon sources that includes a fraction boiling in the range of about 260 to 427° C., which process comprises (i) reacting said stream with hydrogen, in the presence of a hydrodesulfurizing catalyst and hydrogen, at reaction conditions effective to remove most of the labile sulfur, but less than 10% of not the refractory sulfur, and produce a sulfur-reduced stream having a sulfur content of 40 to 100 wppm and H2S, (ii) separating said H2S from said sulfur-reduced stream to produce a stream reduced in H2S, and (iii) contacting said H2S reduced stream with a solid reagent comprising supported sodium having a free sodium content, to remove at least a portion of said refractory sulfur, and produce a second sulfur-reduced stream further reduced in sulfur to a sulfur content of 10 wppm or less, wherein the $H_2S$ reduced stream is contacted with the solid reagent at a temperature of from about 100 to 400° C. and a pressure of from below atmospheric to about 400 psig.

10. A process according to claim 9 wherein said $H_2S$ reduced stream has less than 10 wppm sulfur.

11. A process according to claim 10 wherein not more than about 10 wt. % of said refractory sulfur is removed by said hydrodesulfiarization.

12. A process according to claim 11 wherein said free sodium is present in an amount of from about 1 to about 20 wt. % of said sodium reagent.

13. A process according to claim 9 wherein said middle distillate fuels boiling range stream is derived from petroleum.

* * * * *